US011780049B2

(12) United States Patent
Zuniga et al.

(10) Patent No.: US 11,780,049 B2
(45) Date of Patent: Oct. 10, 2023

(54) POLISHING CARRIER HEAD WITH MULTIPLE ANGULAR PRESSURIZABLE ZONES

(71) Applicant: Applied Materials, Inc., Santa Clara, CA (US)

(72) Inventors: Steven M. Zuniga, Soquel, CA (US); Jay Gurusamy, Santa Clara, CA (US); Andrew J. Nagengast, Sunnyvale, CA (US); Vladimir Galburt, Campbell, CA (US)

(73) Assignee: Applied Materials, Inc., Santa Clara, CA (US)

( * ) Notice: Subject to any disclaimer, the term of this patent is extended or adjusted under 35 U.S.C. 154(b) by 119 days.

(21) Appl. No.: 17/359,410

(22) Filed: Jun. 25, 2021

(65) Prior Publication Data

US 2021/0402558 A1 Dec. 30, 2021

Related U.S. Application Data

(60) Provisional application No. 63/045,680, filed on Jun. 29, 2020.

(51) Int. Cl.
*B24B 37/30* (2012.01)
*B24B 37/10* (2012.01)
(Continued)

(52) U.S. Cl.
CPC ..... *B24B 37/30* (2013.01); *B24B 37/005* (2013.01); *B24B 37/105* (2013.01); *B24B 37/32* (2013.01)

(58) Field of Classification Search
CPC ..... B24B 37/005; B24B 37/04; B24B 37/042; B24B 37/07; B24B 37/10; B24B 37/105;
(Continued)

(56) References Cited

U.S. PATENT DOCUMENTS 5,605,488 A 2/1997 Ohashi et al.
5,964,653 A 10/1999 Perlov et al.
(Continued)

FOREIGN PATENT DOCUMENTS

CN 110919527 3/2020
EP 0841123 A1 * 5/1998 ..... B24B 37/04
JP H11-019867 1/1999

OTHER PUBLICATIONS

International Search Report and Written Opinion in International Appln. No. PCT/US2021/039265, dated Oct. 22, 2021, 10 pages.

*Primary Examiner* — Joel D Crandall
*Assistant Examiner* — Sidney D Hohl
(74) *Attorney, Agent, or Firm* — Fish & Richardson P.C.

(57) ABSTRACT

A carrier head for a polishing system includes a housing, a flexible membrane, a first plurality of pressure supply lines, a second plurality of pressure supply lines, and a valve assembly. The flexible membrane defines a multiplicity of independently pressurizable chambers. The valve assembly has a multiplicity of valves with each respective valve of the multiplicity of valves coupled to a respective pressure chamber from the multiplicity of independently pressurizable chambers. Each respective valve is configured to selectively couple the respective pressure chamber to one pressure supply line from a pair of pressure supply lines that include a pressure supply line from the first plurality of pressure supply lines and a pressure supply line from the second plurality of pressure supply lines.

19 Claims, 7 Drawing Sheets

(51) Int. Cl.
*B24B 37/005* (2012.01)
*B24B 37/32* (2012.01)

(58) Field of Classification Search
CPC ..... B24B 37/27; B24B 37/30; B24B 49/08; B24B 49/16; B24B 7/228; B24B 37/32
See application file for complete search history.

(56) References Cited

U.S. PATENT DOCUMENTS

| | | | | |
|---|---|---|---|---|
| 6,290,584 | B1 | 9/2001 | Kim et al. | |
| 6,648,740 | B2 | 11/2003 | Perlov et al. | |
| 6,767,387 | B2 * | 7/2004 | Yeh | B01D 47/06 95/149 |
| 7,207,871 | B1 * | 4/2007 | Zuniga | B24B 49/16 451/388 |
| 9,233,452 | B2 | 1/2016 | Duescher et al. | |
| 9,604,339 | B2 | 3/2017 | Duescher et al. | |
| 9,884,401 | B2 | 2/2018 | Fukushima et al. | |
| 2002/0042246 | A1 | 4/2002 | Togawa et al. | |
| 2007/0167110 | A1 | 7/2007 | Tseng et al. | |
| 2012/0034848 | A1 | 2/2012 | Chen et al. | |
| 2015/0093971 | A1 | 4/2015 | Fukushima et al. | |
| 2016/0059377 | A1 | 3/2016 | Oh et al. | |
| 2016/0279756 | A1 | 9/2016 | Chang et al. | |
| 2020/0094371 | A1 | 3/2020 | Akazawa et al. | |
| 2021/0402549 | A1 | 12/2021 | Zuniga et al. | |

* cited by examiner

POLISHING CARRIER HEAD WITH MULTIPLE ANGULAR PRESSURIZABLE ZONES

CROSS-REFERENCE TO RELATED APPLICATIONS

This application claims priority to U.S. Application Ser. No. 63/045,680, filed on Jun. 29, 2020, the disclosure of which is incorporated by reference.

TECHNICAL FIELD

The present disclosure relates generally to profile control of a polishing process, and more particularly to a carrier head having a membrane with multiple angularly disposed pressurizable zones.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface and planarizing the filler layer. For certain applications, the filler layer is planarized until the top surface of a patterned layer is exposed or a desired thickness remains over the underlying layer. In addition, planarization may be used to planarize the substrate surface, e.g., of a dielectric layer, for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. In some situations, the carrier head includes a membrane that forms multiple independently pressurizable radially concentric chambers, with the pressure in each chamber controlling the polishing rate in each corresponding region on the substrate. A polishing liquid, such as slurry with abrasive particles, is supplied to the surface of the polishing pad.

SUMMARY

In one aspect, a carrier head for holding a substrate in a polishing system includes a housing, a flexible membrane extending below the housing, a first plurality of pressure supply lines, a second plurality of pressure supply lines, and a valve assembly. The flexible membrane divides a volume above the flexible membrane into a multiplicity of independently pressurizable chambers. The valve assembly is coupled to the first pressure supply lines, the second pressure supply lines and the multiplicity of independently pressurizable chambers. The valve assembly has a multiplicity of valves with each respective valve of the multiplicity of valves coupled to a respective pressure chamber from the multiplicity of independently pressurizable chambers. Each respective valve is configured to selectively couple the respective pressure chamber to one pressure supply line from a pair of pressure supply lines that include a pressure supply line from the first plurality of pressure supply lines and a pressure supply line from the second plurality of pressure supply lines.

In another aspect, a carrier head for holding a substrate in a polishing system includes a housing and a flexible membrane extending below the housing, the flexible membrane dividing a volume above the flexible membrane into a multiplicity of independently pressurizable chambers that are arranged in a polar array.

Implementations may include one or more of the following features.

The multiplicity of independently pressurizable chambers may including include a first plurality of independently pressurizable chambers, and the multiplicity of valves may include a first plurality of valves. Each different valve of the first plurality of valves may be configured to selectably couple a different pressure chamber of the first plurality of pressure chambers to a different pair of pressure supply lines. The multiplicity of independently pressurizable chambers may include a second plurality of independently pressurizable chambers, and the multiplicity of valves may include a second plurality of valves. Each different valve of the second plurality of valves may be configured to selectably couple a different pressure chamber of the second plurality of pressure chambers to a different pair of pressure supply lines.

At least one valve from the first plurality of valves and at least one valve from the second plurality of valves may couple respective chambers to a same pair of pressure supply lines. For example, for every valve from the first plurality of valves, there may be a corresponding valve from the second plurality of valves that couples respective chambers to a same pair of pressure supply lines.

The multiplicity of independently pressurizable chambers may be arranged in a polar array. The polar array includes a central chamber and a plurality of radial rings. Each radial ring may include a plurality of angularly separated chambers. The different pressure supply lines from the first plurality of pressure supply lines may be coupled to chambers of different rings. The different pressure supply lines from the second plurality of pressure supply lines may be coupled to chambers of different angular segments.

Certain implementations can include, but are not limited to, one or more of the following possible advantages.

Each independent chamber can be pressurized to apply a respective pressure on to a substrate in a manner that the pressure applied varies both radially and angularly about the center of a substrate being polished. This permits profile control in a manner that can compensate for angular variation in thickness of an incoming substrate and/or angular variations in the polishing rate of the polishing process. The pressure applied over a region can be controlled by a valve switching between two magnitudes of pressure to apply to a chamber so that the chamber applies the corresponding pressure onto the region. Thus, polishing process of each region of the layer on the substrate can be controlled independently and with higher definition. Moreover, in comparison to using pressure chambers without valves, this method permits scaling to a larger number of control regions in a more feasible manner. In particular, fewer rotary connections are needed, and the number of rotary connections scales much less than the number of independent pressurizable chambers.

The details of one or more embodiments of the invention are set forth in the accompanying drawings and the description below. Other features, objects, and advantages are apparent from the description and drawings, and from the claims.

DETAILED DESCRIPTION

Polishing rate variations between different regions of a substrate can lead to the different regions of the substrate reaching their target thickness at different times. On the one hand, the different regions of the substrate may not reach the desired thickness if polishing of the regions is halted simultaneously. On the other hand, halting polishing for different zones at different times can result in defects or lower the throughput of the polishing apparatus. Thus, there is a need to be able to independently control the pressure on different regions.

In an idealized process, due to the rotation of the carrier head and the platen, the polishing rate on a substrate would be angularly symmetric about the axis of rotation of the substrate. In practice however, the polishing process can result in angular variation in the polishing rate. In addition, a substrate to be polished can have a top layer with an initial thickness that varies angularly, i.e., that has angular non-uniformity. Finally, in some manufacturing processes it may be desirable to induce angular non-uniformity in the thickness of the layer being polished in order to compensate for non-uniformity in later processing steps, e.g., deposition steps. Eliminating angular non-uniformity induced by the polishing process or when polishing a layer with an angularly non-uniform initial thickness, or purposely providing angular variation in the thickness when polishing a layer, remains a challenge.

However, a carrier head that uses multiple independently pressurizable angularly disposed chambers can address this problem. The pressurizable chambers can be arranged angular and radially around a central axis of the carrier head, and each pressurizable chamber is connected to a respective valve. Each valve can switch between a respective pair of pressure inputs such that pressure within each chamber can be controlled independently, permitting reduction or deliberate introduction of angular non-uniformity.

Figure 1A:
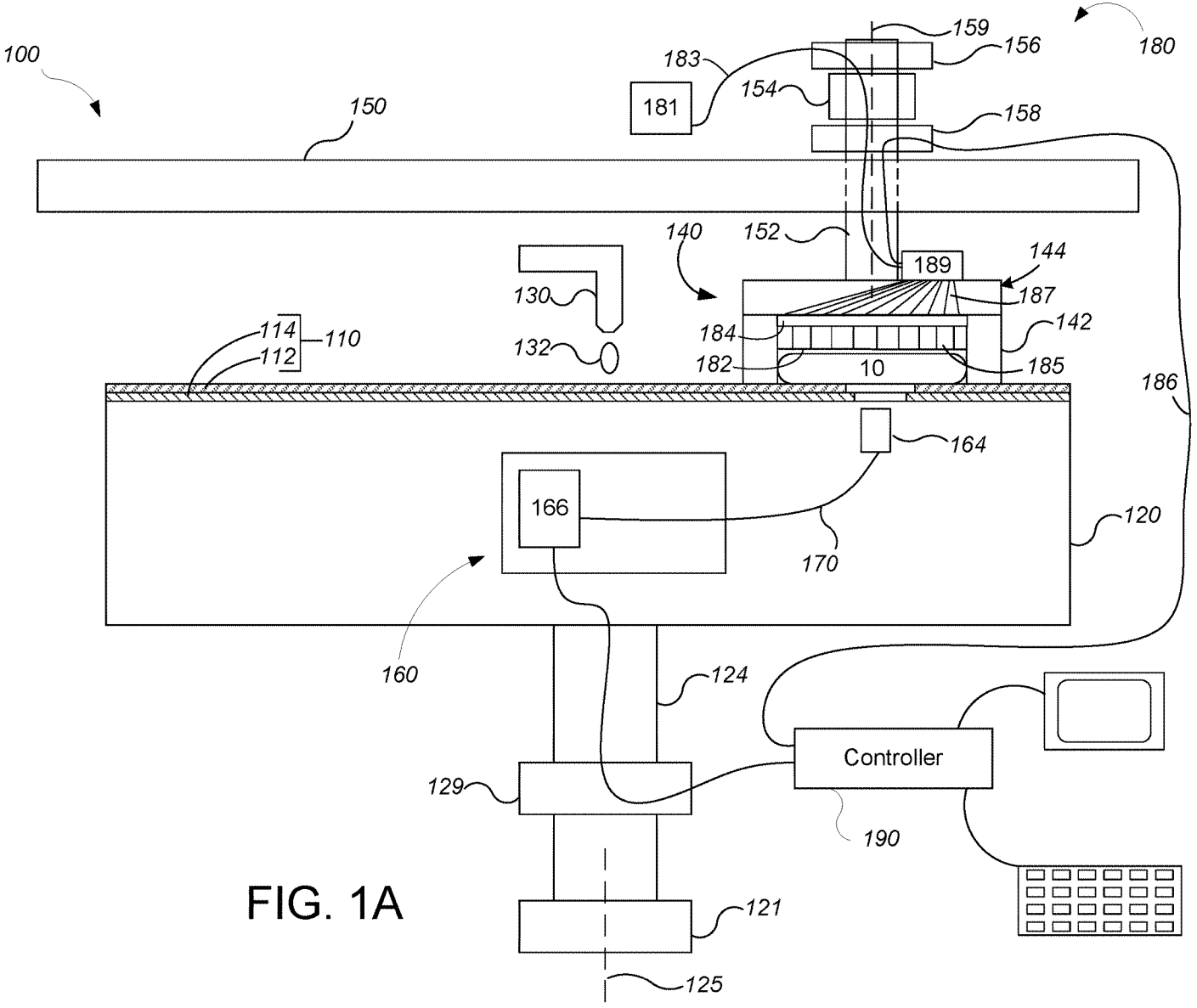
FIG. 1A illustrates a schematic cross-sectional view of an example of a polishing apparatus.

FIG. 1A illustrates an example of a polishing apparatus 100. The polishing apparatus 100 includes a rotatable disk-shaped platen 120 on which a polishing pad 110 is situated. The platen 120 is operable to rotate about an axis 125. For example, a motor 121 can turn a drive shaft 124 to rotate the platen 120. The polishing pad 110 can be detachably secured to the platen 120, for example, by an adhesive layer. The polishing pad 110 can be a two-layer polishing pad with an outer polishing layer 112 and a softer backing layer 114.

The polishing apparatus 100 can include a combined slurry/rinse arm 130. During polishing, the arm 130 is operable to dispense a polishing liquid 132, such as an abrasive slurry, onto the polishing pad 110. The polishing apparatus can also include a polishing pad conditioner to abrade the polishing pad 110 to maintain the polishing pad 110 in a consistent abrasive state.

The polishing apparatus 100 includes a carrier head 140 operable to hold a substrate 10 against the polishing pad 110. The carrier head 140 can be configured to independently control a polishing parameter, for example pressure, for each of multiple zones on the substrate 10.

Figure 1B:
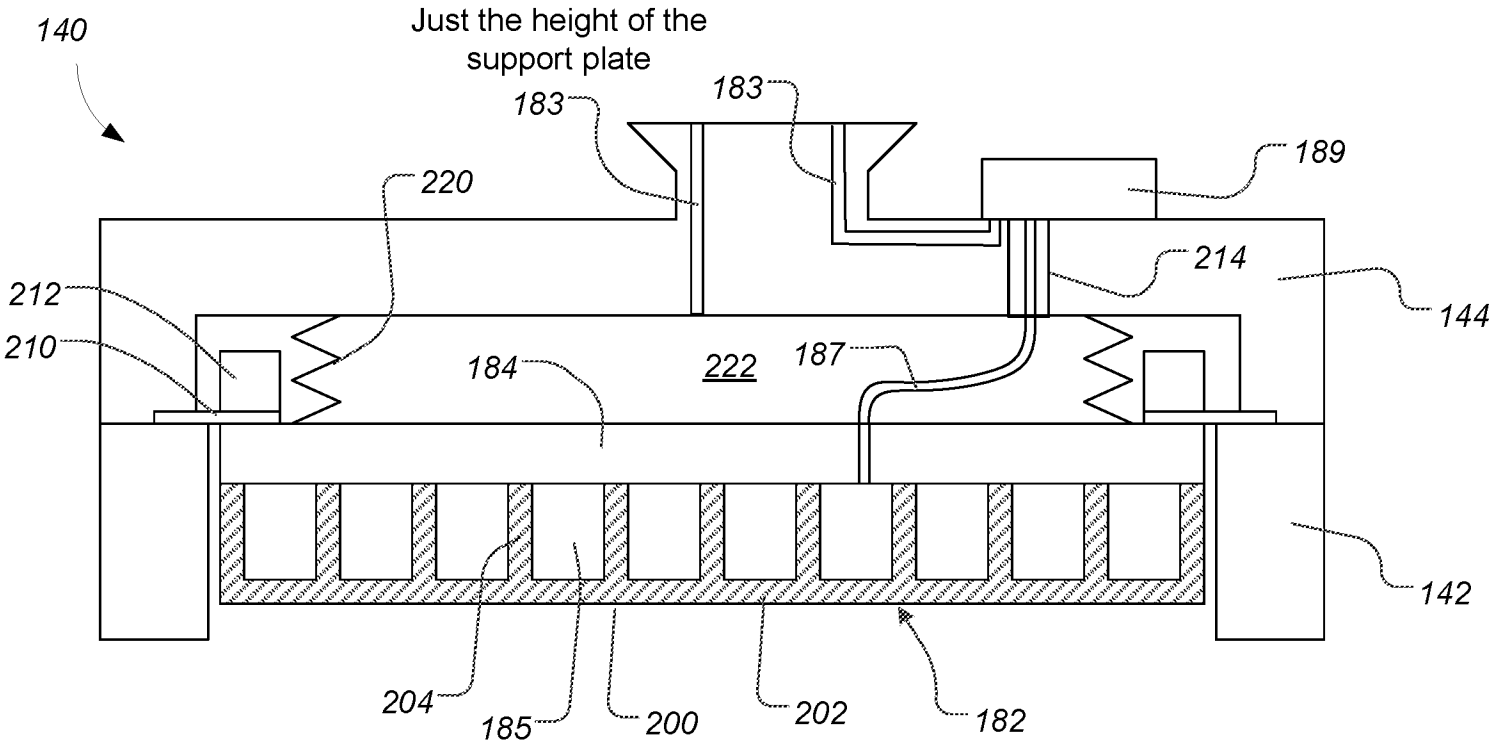
FIG. 1B illustrates a schematic cross-sectional view of a carrier head.

Referring to FIG. 1B, the carrier head 140 can include a housing 144 that can be connected to a drive shaft 152, a support plate 184 that extends above the flexible membrane 182, and retaining ring 142 to retain the substrate 10 below the membrane 182.

The lower surface 200 of the membrane 182 provides a mounting surface for the substrate 10. The membrane 182 can include a horizontally extending main portion 202 which can be circular and can provide the mounting surface, and a plurality of flaps 204 that extend upwardly from the back surface of the main portion 202. The flaps 204 are secured to the support plate 184, e.g., by clamps, such that the flaps 204 divide a volume above the membrane into a plurality of independently controllable pressurizable chambers 185. In particular, as discussed further below, the pressurizable chambers 185 are disposed angularly around the central axis 159 of the carrier head. The membrane 182 can be made of a flexible and somewhat elastic material, e.g., a rubber, such as silicone rubber or neoprene. The membrane can be formed from thermoset materials using a mold such that the molded membrane forms the main portion 202 and flaps 204 as a single body.

In some implementations, the support plate 184 is flexibly connected to the housing 144 such that the support plate is vertically movable relative to the housing. For example, the support plate 184 can be coupled to the housing by a flexure 210, e.g., an annular membrane, formed of a plastic or rubber, e.g., silicon rubber or neoprene. An inner edge of the flexure 210 can clamped between the top of the support plate 184 and a clamp ring 212, and an outer edge of the flexure can be clamped between the retaining ring 142 and the housing 144.

The support plate 184 is more rigid than the membrane 182. For example, the support plate 184 can be a metal, e.g., aluminum or stainless steel, or a hard plastic, e.g., polyether ether ketone (PEEK) or polyphenylene sulfide (PPS). Each independent controllable, pressurizable chamber 185 formed above the membrane 182 is sealed by the support plate 184.

A region between the support plate 184 and the housing 144 can be sealed by an expandable seal 220, e.g., by a flexible membrane or bellows, to form a pressurizable upper chamber 222 between the housing 144 and support plate 184. Alternatively, the flexure 210 could provide the seal. Pressure in the upper chamber 222 can thus control the vertical position of the support plate 184 or downforce of the support plate 184 on the membrane 182. In some implementations, pressure in the upper chamber 222 can control the pressure of the retaining ring 142 on the polishing pad.

In some implementations, the support plate 184 is not movable relative to the housing 144. For example, the support plate 184 could be fixed to the housing 144 or be provided by a portion of the housing 144. In this case, there is no need for a seal 210 or chamber 222.

Returning to the independently pressurizable chambers 185 formed by the membrane 182, the pressure applied onto a region of the substrate 10 depends on the pressure in the associated chamber 185. Because the chambers are disposed at different angular and radial positions about the center of the carrier head, the pressure on the substrate 10 can be also controlled independently at respective annular and angular positions. Although only ten chambers are illustrated in FIG. 1 for ease of illustrations, there can be more chambers, twenty to one-hundred chambers, e.g. sixty-six chambers.

Figure 3B:
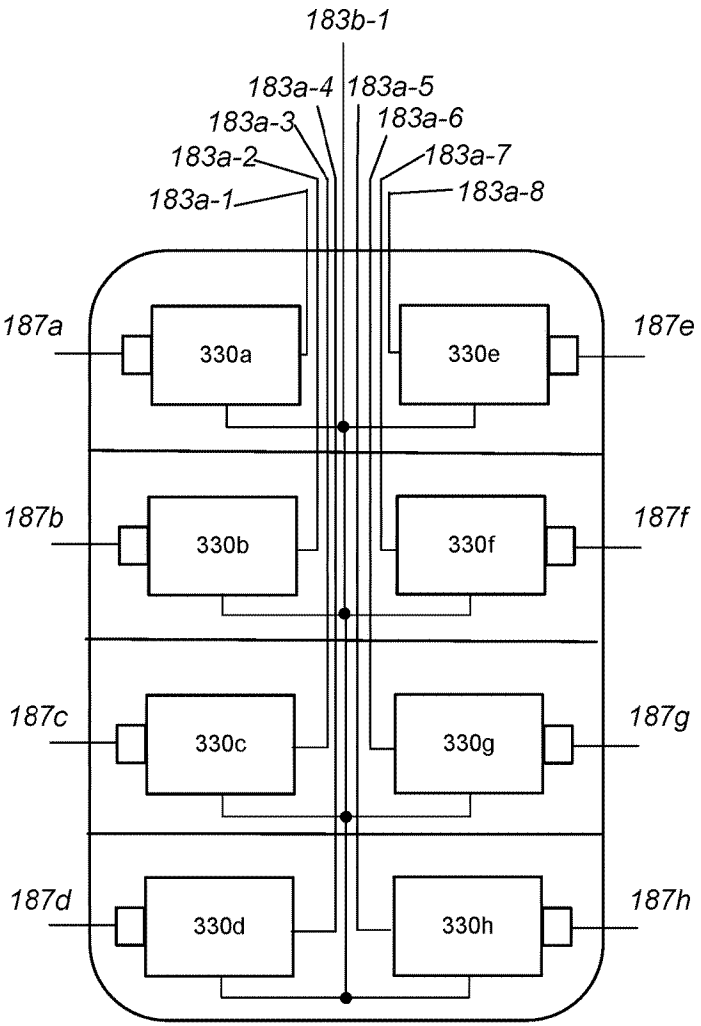
FIG. 3B illustrates a schematic top view of an example valve bank.
Figure 3A:
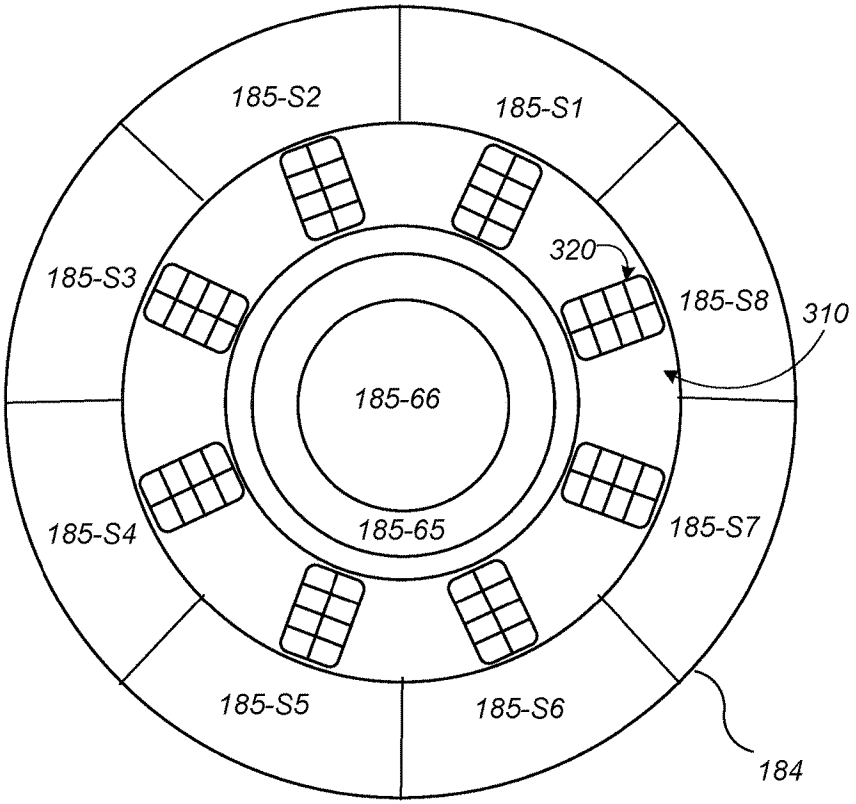
FIG. 3A illustrates a schematic top view of an example annular valve assembly having valve banks mounted on top of a support plate.

A valve assembly 189, e.g., a type of equipment which connects two or more valves in a manner that a variety of isolate valves can be combined in a single body configuration, is secured to the carrier head 140. For example, the valve assembly can be mounted on the top of the housing 144 of the carrier head 140, as shown in FIGS. 1A and 1B. For another example, the valve assembly can be mounted on top of the support plate 184 inside the carrier head 140, as shown in FIG. 3A Returning to FIG. 1B, each chamber 185 is connected to a dedicated valve in the valve assembly 189, e.g., by a pressure output line 187. Each pressure output line 187 can be provided by passages through the support plate 184 and/or housing 144 and/or flexible tubing. Although only one pressure output line 187 is shown in FIG. 1B for ease of illustration, there would be a separate pressure output line 187 for each chamber 185.

The valve assembly 189 can receive a plurality of pressure inputs through a plurality of pressure supply lines 183 from a plurality of pressure sources 181. Again, although only one pressure supply line 183 and one pressure source 181 are shown in FIGS. 1A and 1B for ease of illustrations, there can be more pressure supply lines, e.g., eight to sixteen pressure supply lines, and there can be more pressure sources, e.g. eight to sixteen pressure sources. The pressure supply lines 183 can be provided by passages through the drive shaft 152 and/or housing 144 and/or flexible tubing, and a rotary union 214 extending through the upper chamber 222. Pressure can be routed from the stationary components, e.g., the pressure source 183, through a rotary pneumatic union 156, to the carrier head 140.

The valve assembly 189 can also receive data through a data line 186 from a controller 190. The voltage supply line 183 and the data line 186 can be routed through the drive shaft 152 and a rotary electrical union 158, e.g., a slip ring, to the stationary components such as the controller 190.

The valve assembly 189 can independently control each valve, based on the data, to switch each corresponding chamber 185 between a pair of corresponding pressure supply lines. That is, each pressure output line 187 can be selectively coupled by an associated valve to one of two pressure supply lines 183.

The data line 186 can transfer a plurality of frames of data, and each frame of a plurality of frames can include data that represents a signal of switching a pressure, or an equivalent pressure signal, for one or more of the independent chamber. In some implementations, a frame of data transmitted by the controller 190 includes a control value and an identification value associated to each valve, or equivalently each chamber, to which the control value applied, and the valve assembly 189 is configured to determine a switch of pressure to a chamber based on the control value and the identification value.

Due to the inclusion of the valve assembly 189, the number of pressure sources and pressure input lines can be reduced at least half as compared to a carrier head having a corresponding number of chambers but without a valve assembly. Thus the number of independently controllable pressurizable chambers can be scaled up with less of an increase in the number of rotary connections, while still maintain adjustability of pressure at each chamber. Given that, the polishing assembly can be simpler in design and more reliable under operation.

Figure 2A:
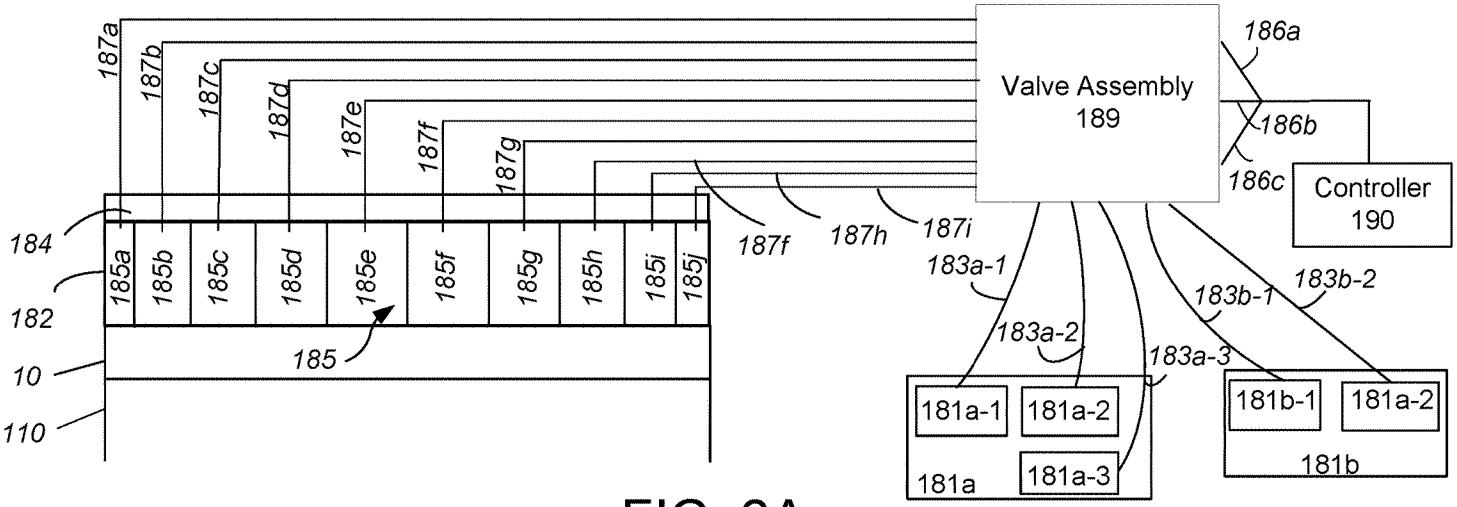
FIG. 2A is a schematic diagram illustrating a pressure control assembly for controlling pressure on a substrate.
Figure 2B:
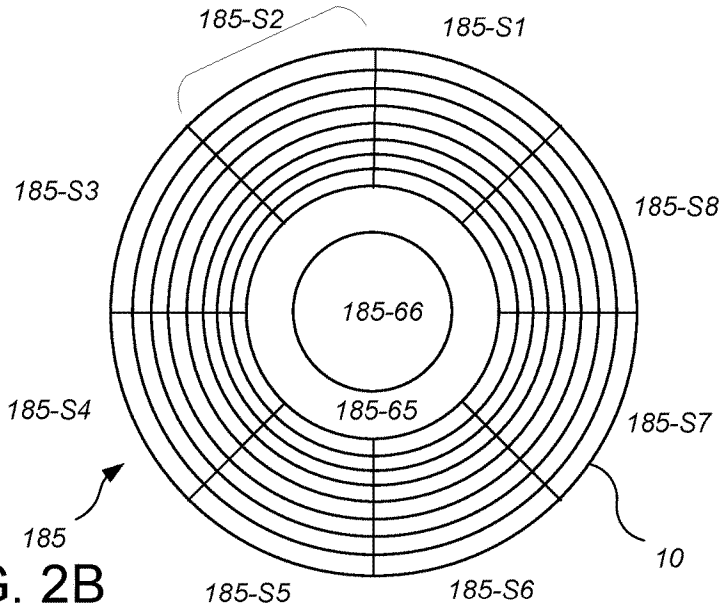
FIG. 2B illustrates a schematic bottom view of a carrier head having independently pressurizable chambers in a polar array.

FIG. 2A is a schematic diagram that shows a portion of a carrier head 140, the substrate 10, and the polishing pad 110. As illustrated in FIG. 2A, a pressure control assembly includes the valve assembly 189, two pressure source banks 181*a* and 181*b*, and the controller 190. The valve assembly 189 is connected to each pressurizable chamber 185 though a respective pressure output line 187. FIG. 2A illustrates ten independent pressurizable chambers 185*a*-185*j*, but as mentioned above the total number of chambers can be more than ten. For example, in the configuration as shown in FIG. 2B, there can be sixty-six chambers.

Returning to FIG. 2A, each chamber 185*a*-185*j* is connected to a respective valve in the valve assembly 189 through a respective pressure output line, e.g., 187*a*-187*j*. Each valve can control/switch a pressure output line between a pair of pressure supply lines to apply the selected pressure to the associated pressure chamber.

The pressure source bank 181*a* and 181*b* each can include a plurality of pressure sources. As shown in FIG. 2A, the pressure source bank 181*a* can have three primary pressure sources, 181*a*-1 to 181*a*-3, and the bank 181*b* can have two secondary primary pressure sources, 181*b*-1 and 1816-2. Each pressure source can supply a pressure at an independently controllable magnitude, respectively. Each pressure source from each bank is connect to the valve assembly 189 by a separate pressure supply line 183. For example, the pressure source 181*a*-1 inside the pressure bank 181*a* is connected to the valve assembly 189 by the pressure supply line 183*a*-1. Inside the valve assembly 189, each pressure supply line 183 can be split to connect with a plurality of different valves.

Each valve inside the valve assembly 189 is connected with two pressure sources, namely a pair of pressure sources, namely a primary pressure and a secondary pressure. The primary pressure can come from a pressure source inside the primary pressure bank 181*a* and the secondary pressure can come from a pressure source inside the secondary pressure bank 181*b*. For example, a valve inside the valve assembly 189 is connected to a pair of pressure supplies, e.g., 181*a*-2 and 181*b*-1, with a pair of separate pressure supply lines, e.g., 183*a*-2 and 183*b*-1. The total number of pressure source banks and pressure sources inside a pressure bank in FIG. 2A is only illustrative, more pressure sources can be incorporated inside a pressure bank accordingly, and more pressure banks can be included. For example, there can be at least four primary pressure sources in the primary pressure bank 181*a* and at least four secondary pressure sources inside the secondary pressure bank 181*b*. There can be eight primary pressure sources inside the primary pressure bank 181*a*. There can be four secondary pressure sources inside the secondary pressure bank 181*b*. The data line 186 connecting the controller 190 and the valve assembly 189 can split into multiple threads, e.g., 186*a*-186*c* outside the valve assembly 189, so that each valve is connected to a separate data line. Given this, each valve can be controlled independently based on frames of data transmitted from the controller 190. In some implementations, the data line 186 can also split inside the valve assembly 189.

FIG. 2B illustrates a schematic bottom view of an example carrier head having pressurizable chambers 185 arranged in a polar array. The chambers are divided into a plurality of concentric rings, e.g., nine concentric rings, surrounding a circular center chamber, e.g., 185-66 by angularly extending membrane walls (provided by the flaps 204 of the membrane 182). At least two of the rings can have the same radial width. For example, the outer two rings can have the same width, which can be different from a width of other rings. Alternatively each ring can have a different width, or all of the rings can have the same width. In some implementations, at least one chamber is narrower than another chamber that is radially closer to the center of the carrier head. For example, the concentric rings can be progressively narrower the further the ring is from the center of the carrier head.

The chambers in different rings can be connected to different primary pressure sources, but the chambers in a particular ring can be connected to a common primary pressure source, which will be described further below.

At least two of the rings, e.g., the outer eight rings, are further divided into a plurality of arcuate sections by a plurality of radially-extending membrane walls (provided by the flaps 204 of the membrane 182). For example, a ring can be divided into eight sections by seven radially-extending membrane walls. In some implementations, each section spans the same central angle, e.g., forty-five in degrees or a quarter of $\pi$ in radians. In this case, the arcuate chambers in the rings that are further from the center of the carrier head are longer. In some implementations, the sections are uniformly spaced around the central axis. Alternatively, at least two sections can have a larger central angle, e.g. sixty in degrees, than other sections, e.g., thirty in degrees, according to polishing requirements.

The chambers in a particular section can be connected to a common secondary pressure source. However, for some pairs of sections, the chambers in different sections of the pair of sections can be connected to different secondary pressure sources. In some implementations, each section is connected to a different secondary pressure sources. Alternatively, some sections are connected to the same secondary pressure sources, but some sections are connected to different pressure sources. For example, adjacent sections can be connected to different pressure sources.

Figure 2C:
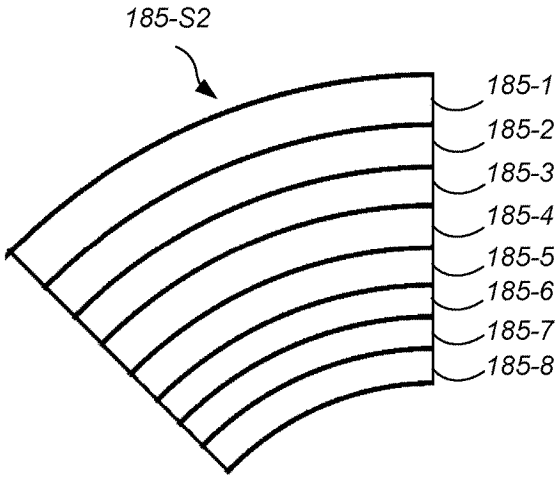
FIG. 2C illustrates an expanded view of a section of the polar array from FIG. 2B.

FIG. 2C illustrates eight arcuate chambers 185-1 to 185-8 that lie in a section 185-S2. Each arcuate chamber inside the same section occupies the same central angle with respect to each ring that the arcuate chamber lies in. Assuming eight rings and eight sections formed by the flaps 204 of the membrane 182, there are sixty-four arcuate chambers 185-1 to 185-64.

Optionally, one or more inner ring-shape chambers 185-65 can surrounds the central circular chamber 185-66. For example, there can be a ring-shaped chamber 185-65 positioned between the central circular chamber 185-66 and rings that are divided into sections. Thus, in this implementation, there are sixty-six chambers formed by the membrane. Each chamber of the sixty-four chambers is connected to a respective primary pressure source and a respective secondary source, whereas the inner ring-shape chamber 185-65 and the central circular chamber 185-66 are connected to just a respective primary pressure source. The primary pressure sources for chamber 185-65 and 185-66 can come from a different pressure bank, e.g., 181*c*.

Referring to FIG. 1B, in some implementations, the valve assembly 189 can be secured on top of the support plate 184 inside the housing 144, as shown by FIG. 3A. An annular valve assembly 310 can include multiple valve banks 320 arranged angularly around and secured to the top surface of the support plate 184. Each valve within a valve bank 320 controls pressure supplied to each arcuate chamber of the corresponding section that the valve bank is assigned to. For example, as shown in FIG. 3B, the valve bank 320 is assigned to the section 185-S8, and each valve, e.g., 330*a*-330*h*, in the valve bank is connected to each respective arcuate chamber, e.g., 185*a*-185*h*, through a respective pressure output line, e.g., 187*a*-187*h*. Each valve is also connected to a respective primary pressure source, e.g. 181*a*-1 to 181*a*-8, through a respective pressure supply line, e.g., 183*a*-1 to 183*a*-8. On the other hand, all the valves in a respective valve bank are connected to a common secondary pressure source, e.g., 181*b*-1, through a pressure supply line 183*b*-1. Thus, each valve of a valve bank 320 can switch a pressure between a respective pair of primary pressure and a common secondary pressure to apply into each arcuate chamber within the associated section. As for the center chambers 185-65 and 185-66, each independent pressure source 181*c*-1 and 181*c*-2 is directly applied into the two chambers without a valve, through pressure supply line 183*c*-1 and 183*c*-2, which is not explicitly illustrated in FIG. 3A for ease of illustrations.

In some implementations, the total number of combinations of primary pressure sources and secondary pressure sources is the product of the number of primary pressure sources and the secondary pressure sources.

Given each chamber is connected to a respective valve that can switch a pressure output line between a respective pair of a primary pressure source and a secondary pressure source, among all chambers there are at least two separate chambers where each of the two chambers connects to a separate valve, but each valve couples the associated chamber with the same pair of pressure sources. The two chambers can be located in a manner that, for example, they lie on the same ring but in a different pair of sections, for another example, the two chambers lie on a different pair of rings and in a different pair of sections.

In some implementations, each arcuate chamber lying on the same concentric ring share the same primary pressure source. For example, 185-1 and 185-9 are two angular portions of the outmost ring and they share the same primary pressure source 181*a*-1 through respective pressure output supply lines and respective pressure supply lines, even though they do not belong to the same section. Each arcuate chamber within the same section shares a common secondary pressure source, as explained earlier. For example, the accurate chambers 185-1 to 185-8 lying in the section 185-S8 shares the same secondary pressure source 181*b*-1.

Figure 3C:
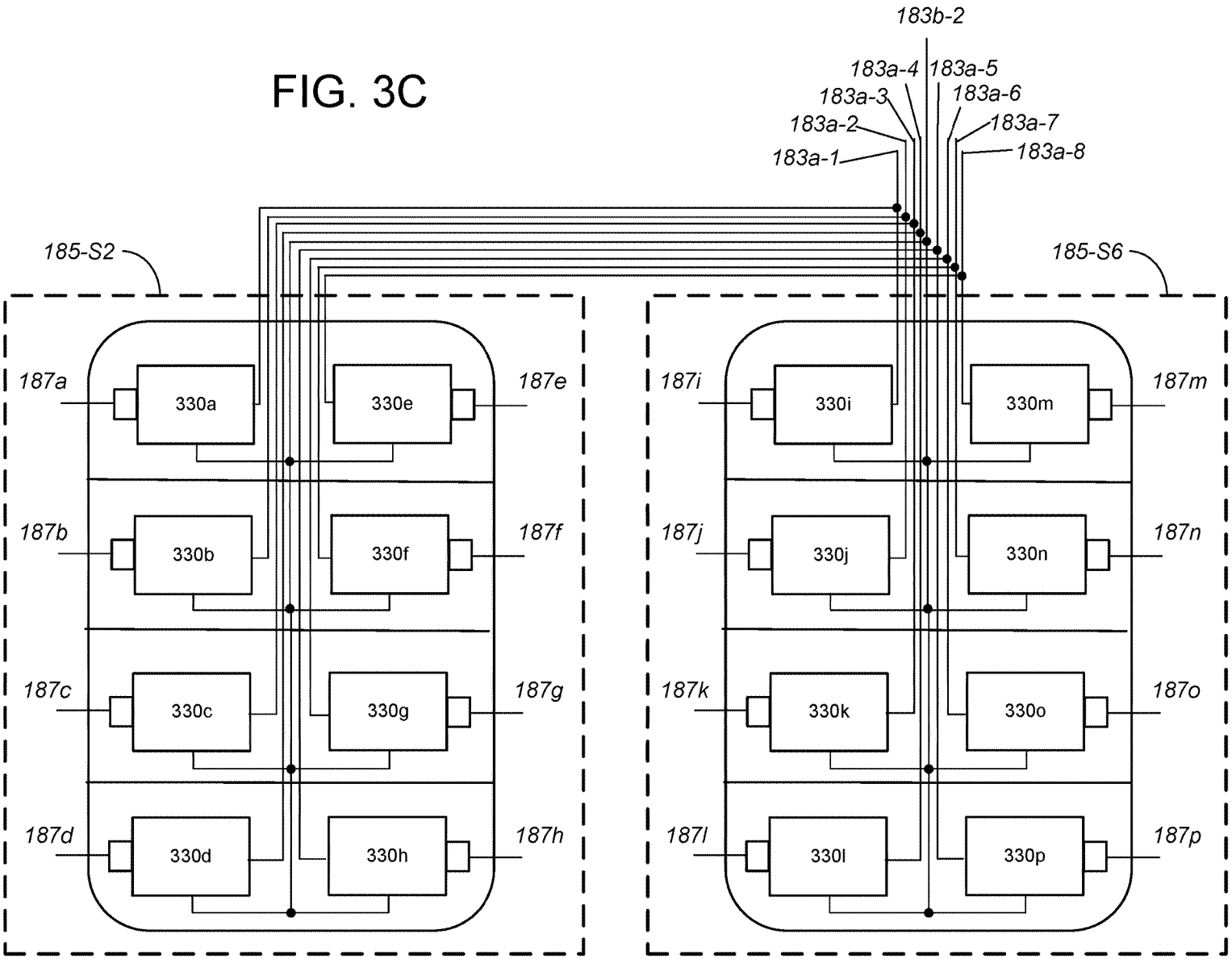
FIG. 3C is a schematic diagram of connections in an example annular valve assembly.

In some implementations, one secondary pressure source is shared by chambers in one or more sections. For example, four independent secondary pressure sources, e.g., 181*b*-1 to 181*b*-4, are shared by eight sections, e.g., 185-S1 to 185-S8. Namely, one secondary pressure source is shared by chambers in a pair of sections. For example, as shown in FIG. 3C, chambers in a pair of sections 185-S2 and 185-S6 share the same secondary pressure source 181*b*-2. For another example, chambers in a pair of sections 185-S8 and 185-S7 share the same secondary pressure source 183*b*-4. Without losing generality, sections that are most separated apart can share the same secondary pressure source to achieve the best control performance.

In this implementation, there are at least eight primary pressure sources, e.g., 181*a*-1 to 181*a*-8, each shared by chambers lying on respective outer concentric rings, two independent primary pressure sources, e.g., 181*c*-1 and 181*c*-2, for inner chambers 185-65 and 185-66, and four secondary pressure sources each shared by chambers in a respective pair of four pairs of sections.

Returning to FIG. 1A, the carrier head 140 is suspended from a support structure 150, e.g., a carousel, and is connected by a drive shaft 152 to a carrier head rotation motor 154 so that the carrier head can rotate about an axis 155. Optionally the carrier head 140 can oscillate laterally, e.g., on sliders on the carousel 150; or by rotational oscillation of the support structure 150 itself. In operation, the platen is rotated about its central axis 125, and each carrier head 140 is rotated about its central axis 155 and translated laterally across the top surface of the polishing pad 110.

The polishing apparatus can include an in-situ monitoring system 160, which can be used to determine whether to adjust a polishing rate or an adjustment for the polishing rate as discussed below. In some implementations, the in-situ monitoring system 160 can include an optical monitoring system, e.g., a spectrographic monitoring system. In other implementations, the in-situ monitoring system 160 can include an eddy current monitoring system.

The in-situ monitoring system 160 includes a sensor 164, and circuitry 166 coupled to the sensor for sending and receiving signals between a controller 190, e.g., a computer. The sensor 164 can be, e.g., an end of an optical fiber to collect light for an optical monitoring system, or a core and coil of an eddy current monitoring system. The output of the circuitry 166 can be a digital electronic signal that passes through a rotary coupler 129, e.g., a slip ring, in the drive shaft 124 to the controller 190. Alternatively, the circuitry 166 could communicate with the controller 190 by a wireless signal.

Figure 4A:
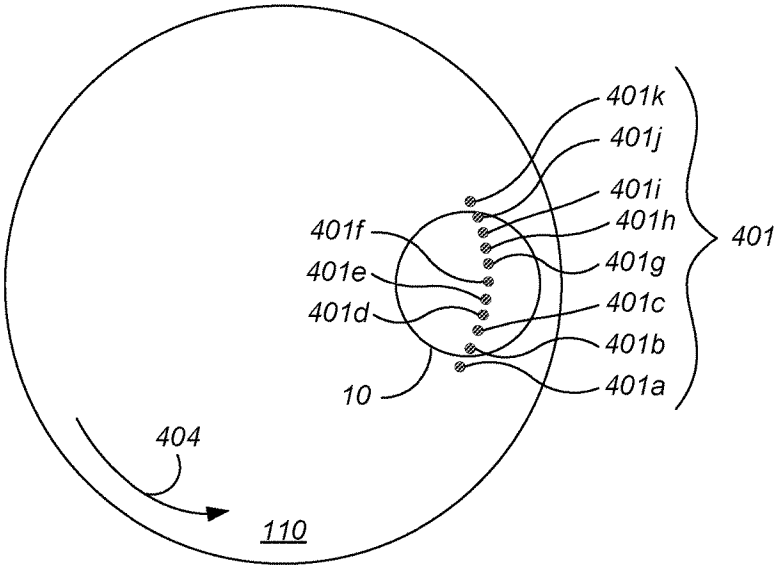
FIG. 4A illustrates a top view of a polishing pad and shows locations where in-situ measurements are taken on a substrate.

As shown by in FIG. 4A, if the detector is installed in the platen, due to the rotation of the platen (shown by arrow 404), as the sensor 164 of the in-situ monitoring system 160 travels below the carrier head, in-situ measurements that depend on a thickness of a layer on the substrate are taken at a sampling frequency so that the measurements are at locations 401 in an arc that traverses the substrate 10. For example, each of points 401*a*-401*k* represents a location of a measurement by the monitoring system of the substrate 10 (the number of points is illustrative; more or fewer measurements can be taken than illustrated, depending on the sampling frequency). Due to the rotation of the carrier head 140 as the sensor 164 sweeps due to the motor 121, measurements are obtained from different radii and angular positions on the substrate 10.

Thus, for any given scan of the in-situ monitoring system across the substrate, based on timing, motor encoder information, rotary position sensor data, e.g., from an optical interrupter sensor positioned to detect a flange attached to an edge of the platen, and optical or eddy current detection of the edge of the substrate and/or retaining ring, the controller 190 can calculate both the radial position (relative to the center of the particular substrate 10 being scanned) and the angular position (relative to the reference angle of the particular substrate 10 being scanned) for each measurement from the scan.

Figure 4B:
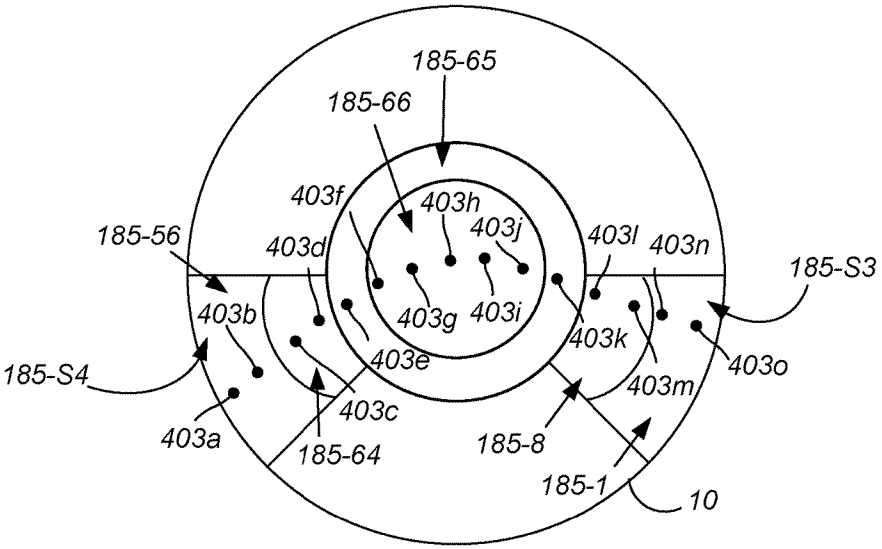
FIG. 4B illustrates a schematic top view of a distribution of multiple locations where in-situ measurements are taken relative to independent pressurizable chambers of the membrane.

As an example, referring to FIG. 4B, in one rotation of the platen, in-situ measured data corresponding to different locations 403*a*-403*o* are collected by the sensor 164. Based on the radial and angular positions of the locations 403*a*-403*o*, each measured data collected at locations 403*a*-403*o* is associated with an independent chamber zone 185-1 to 185-66. Specifically, data collected at locations 403*f*-403*j* are associated with the central circular chamber zone 185-66, and ones collected at locations 403*e* and 403*k* are associated with the innermost ring-shape chamber zone 185-65. Data collected at locations 403*a* and 403*b* are associated with the arcuate chamber zone 185-S6 in section 185-S4, ones collected at locations 403*c* and 403*d* are associated with the arcuate chamber zone 185-64 in section 185-S4, ones collected at locations 4031 and 403*m* are associated with the arcuate chamber zone 185-8 in section 185-S3, and ones collected at locations 403*n* and 403*o* are associated with the arcuate chamber zone 185-1 in section 185-S3. Note here that for ease of illustration, there are two arcuate chambers in each section depicted in FIG. 4B, whereas the number of arcuate chambers in each section can be eight or more. The number of spectra associated with each chamber zone may change from one rotation of the platen to another. Of course, the numbers of locations given above are simply illustrative, as the actual number of measurements associated with each chamber zone will depend at least on the sampling rate, the rotation rate of the platen, and the radial width of each chamber zone.

For each measurement, the controller 190 can calculate a characterizing value. The characterizing value is typically the thickness of the layer under polishing, but can be a related characteristic such as thickness removed. In addition, the characterizing value can be a physical property other than thickness, e.g., metal line resistance. In addition, the characterizing value can be a more generic representation of the progress of the substrate through the polishing process, e.g., an index value representing the time or number of platen rotations at which the spectrum would be expected to be observed in a polishing process that follows a predetermined progress.

Generally, a desired thickness profile is to be achieved for the substrate at the end of a polishing process (or at the endpoint time when the polishing process stops). The desired thickness profile may include the same predetermined thickness for all zones of the substrate 10, or different, predetermined thicknesses for different zones of the substrate 10. When multiple substrates with non-uniform initial thicknesses are polished simultaneously, the multiple substrates may have the same desired thickness profile or different desired thickness profiles.

In some implementations, to keep the measured thickness relationships between the control zones and the reference zone similar to or the same as the thickness relationships illustrated by the desired thickness profile(s) at the endpoint time throughout the polishing process, the controller and/or computer can schedule to adjust the polishing rates of the control zones at a predetermined rate, e.g., every given number of rotations, e.g., every 5 to 50 rotations, or every given number of seconds, e.g., every 2 to 20 seconds. In some ideal situations, the adjustment may be zero at the prescheduled adjustment time. In other implementations, the adjustments can be made at a rate determined in-situ. For example, if the measured thicknesses of different zones are vastly different from the desired thickness relationships, then the controller and/or the computer may decide to make frequent adjustments for the polishing rates.

During polishing, the pressure applied on each region of the layer on a substrate is equal to the pressure applied in each chamber in the membrane 182, as the pressure is transmitted from a chamber to a corresponding region of the substrate. Thus controlling a pressures applied onto a control region of the substrate includes switching a pressure between a pair of a primary pressure and a secondary pressure associated to the corresponding chamber. In some implementations, a preset of primary and secondary pressure magnitude can be learned from open-loop polishing experiments, where the thickness profile at the end of polishing is measured and analyzed to determine how much difference in magnitude should be between a primary pressure and a secondary pressure.

Figure 5:
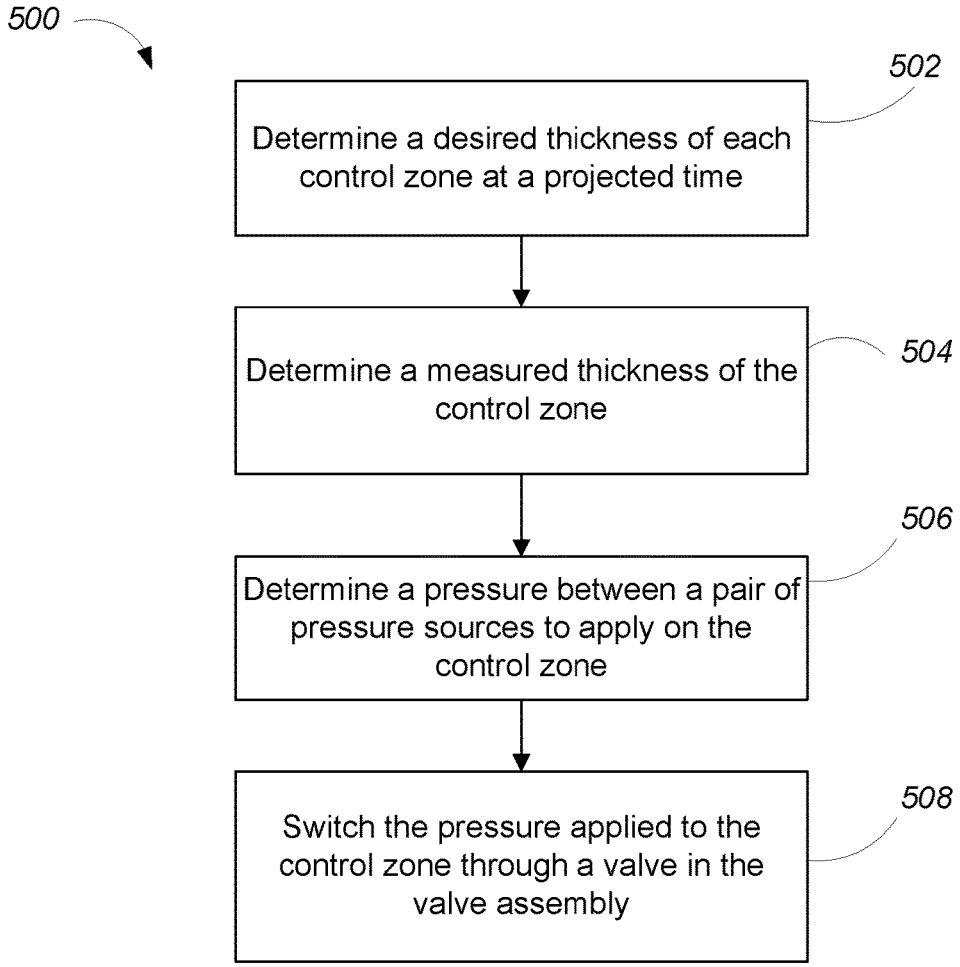
FIG. 5 is a flow diagram showing an example profile control process with independent pressurizable chambers during polishing.

FIG. 5 illustrates a flow diagram of the profile control process with independent pressurizable chambers during polishing (500), which includes determining an expected thickness of each control zone at a projected time (502), determining a measured thickness of the control zone (504), determining a pressure between a pair of pressure sources to apply on the control zone (506), and switching the pressure applied to the control zone through a valve in the valve assembly (508). Steps 502-506 can be realized using an in-situ monitoring system and controller, and step 508 can be carried out on the valve assembly 189. Signals representing the desired pressure (or switching between a pair of a primary pressure and a secondary pressure) for each control zone will be transferred from the monitoring system 160 into the valve assembly 189. In some implementations, the identification signal of each chamber is processed within the controller 190. In some implementations, however the identification signal can be processed within the valve assembly 189. Note here that the switching between a primary pressure and a secondary pressure applied in each arcuate chamber is accurate enough for the purpose of controlling polishing rate on the corresponding control zone, and a delicate preset for pressure sources can further enhance the control result.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Control of the various systems and processes described in this specification, or portions of them, can be implemented in a computer program product that includes instructions that are stored on one or more non-transitory computer-readable storage media, and that are executable on one or more processing devices. The systems described in this specification, or portions of them, can be implemented as an apparatus, method, or electronic system that may include one or more processing devices and memory to store executable instructions to perform the operations described in this specification.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

Other embodiments are within the scope of the following claims.

What is claimed is:

1. A carrier head for holding a substrate in a polishing system, comprising:

a housing;

a flexible membrane extending below the housing, the flexible membrane dividing a volume above the flexible membrane into a multiplicity of independently pressurizable chambers;

a first plurality of individually pressurizable pressure supply lines;

a second plurality of individually pressurizable pressure supply lines; and a valve assembly coupled to the first plurality of pressure supply lines, the second plurality of pressure supply lines and the multiplicity of independently pressurizable chambers, the valve assembly having a multiplicity of valves, wherein each respective valve of the multiplicity of valves is coupled to one respective pressurizable chamber from the multiplicity of independently pressurizable chambers, and wherein each respective valve is configured to selectively couple the one respective pressurizable chamber to one pressure supply line from a respective pair of pressure supply lines, each respective pair of pressure supply lines including a pressure supply line from the first plurality of pressure supply lines and a pressure supply line from the second plurality of pressure supply lines.

2. The carrier head of claim 1, wherein the multiplicity of independently pressurizable chambers includes a first plurality of independently pressurizable chambers and the multiplicity of valves includes a first plurality of valves, and wherein each valve of the first plurality of valves is configured to selectably couple a different pressure chamber of the first plurality of pressurizable chambers to a pair of pressure supply lines that is different than a pair of pressure supply lines coupled to any other valve of the first plurality of valves.

3. The carrier head of claim 2, wherein the multiplicity of independently pressurizable chambers includes a second plurality of independently pressurizable chambers and the multiplicity of valves includes a second plurality of valves, and wherein each valve of the second plurality of valves is configured to selectably couple a different pressurizable chamber of the second plurality of pressurizable chambers to a pair of pressure supply lines that is different than a pair of pressure supply lines coupled to any other valve of the second plurality of valves.

4. The carrier head of claim 3, wherein at least one valve from the first plurality of valves and at least one valve from the second plurality of valves couple respective chambers to a common pair of pressure supply lines.

5. The carrier head of claim 4, wherein for every valve from the first plurality of valves there is a corresponding valve from the second plurality of valves that couples respective chambers to a common pair of pressure supply lines.

6. The carrier head of claim 1, wherein the first plurality of pressure supply lines comprises more pressure supply lines than the second plurality of pressure supply lines.

7. The carrier head of claim 6, wherein the first plurality of pressure supply lines and the second plurality of pressure supply lines each comprise at least 4 pressure supply lines.

8. The carrier head of claim 7, wherein the first plurality of pressure supply lines has no more than 8 pressure supply lines and the second plurality of pressure supply lines has no more than 4 pressure supply lines.

9. The carrier head of claim 1, wherein the multiplicity of independently pressurizable chambers comprises one or more chambers connected to a third plurality of pressure supply lines.

10. The carrier head of claim 9, wherein the one or more chambers are coupled to a preset one or more passages in a drive shaft through the third plurality of pressure supply lines.

11. The carrier head of claim 1, wherein the multiplicity of independently pressurizable chambers includes chambers arranged at different angular positions around a central axis of the carrier head.

12. The carrier head of claim 11, wherein the multiplicity of independently pressurizable chambers includes chambers arranged at different radial positions from the central axis of the carrier head.

13. The carrier head of claim 11, the multiplicity of independently pressurizable chambers are arranged in a polar array.

14. The carrier head of claim 13, wherein the polar array includes a central chamber and a plurality of radial rings, each radial ring including a plurality of angularly separated chambers.

15. The carrier head of claim 13, wherein a plurality of angularly separated chambers are evenly spaced around the central axis.

16. The carrier head of claim 1, wherein the multiplicity of valves comprise electromagnetic valves.

17. The carrier head of claim 16, comprising circuitry secured to the housing to receive data on a data line and configured to selectively actuate the valves of the multiplicity of valves based on the data.

18. The carrier head of claim 1, comprising a support plate flexibly connected to the housing so as to be vertically movable relative to the housing, and wherein the flexible membrane is secured to the support plate and the multiplicity of pressurizable chambers are formed between the flexible membrane and the support plate.

19. The carrier head of claim 18, wherein a volume between the support plate and the housing is controllably pressurizable.

* * * * *